United States Patent [19]

Lee

[11] 4,434,894

[45] Mar. 6, 1984

[54] DUAL PURPOSE PALLET SHEET

[75] Inventor: Chong H. Lee, Lake Forest, Ill.

[73] Assignee: Suh Won America, Inc., Waukegan, Ill.

[21] Appl. No.: 439,311

[22] Filed: Nov. 4, 1982

[51] Int. Cl.[3] ..... B65D 19/20; B65D 57/00; A45C 13/02

[52] U.S. Cl. ..... 206/526; 206/600; 150/52 F; 150/DIG. 1; 150/31; 383/33; 383/111

[58] Field of Search ..... 206/526, 223, 577, 386, 206/600; 150/31, 52 F, 2.7, DIG. 1; 190/41 C, 43, 48, 49, 50

[56] References Cited

U.S. PATENT DOCUMENTS 3,998,304 12/1976 Edgerton, Jr. et al. ..... 190/48

4,077,451 3/1978 Zoland ..... 150/31

4,141,399 2/1979 Zoland ..... 150/31

4,142,564 3/1979 Zoland ..... 150/31

*Primary Examiner*—William T. Dixson, Jr.

*Assistant Examiner*—Bryon Gehman

*Attorney, Agent, or Firm*—Fitch, Even, Tabin & Flannery

[57] ABSTRACT

A specialty package in which a plurality of flexible cloth bags are shipped with the bags neatly folded in flattened condition and arranged side-by-side in separate layers, simulating separate compartments, within an outer shipping container. The compartments are provided by rectangular pieces of sheet material which are equal in number to the bags and which serve a dual purpose, functioning as expanders for display of the bags at the point of sale.

5 Claims, 6 Drawing Figures

13
15
11
19
17

23

23
21
21

23
27
25

21
25
31
27
27

21
29
27

DUAL PURPOSE PALLET SHEET

The present invention relates to specialty packaging and more particularly to a specialty package for shipping and merchandising cloth zipper bags of generally cylindrical shape.

BACKGROUND OF THE INVENTION

Recently, in the United States and other countries, cloth zipper bags have become popular items, which bags are generally made of woven nylon cloth and have the general shape of a right circular cylinder. It has been found that the salability of these bags suffers when the bags are merely displayed limp in flattened condition on a counter, and accordingly it has been the practice to crumple heavy paper or the like to provide stuffing material which can be used to expand or extend the bag to its filled shape. This practice is not only time-consuming and wasteful of materials, but it often requires the store to dispose of the stuffing material upon sale, a further inconvenience.

SUMMARY OF THE PRESENT INVENTION

A specialty package is provided in which a plurality of flexible cloth bags are shipped with the bags neatly folded in flattened condition and arranged side-by-side in neat layers, simulating separate compartments, within an outer shipping container. The compartments are provided by rectangular pieces of sheet material which serve a dual purpose because they also function as expanders for display of the merchandise at the point of sale.

DETAILED DESCRIPTION OF THE PREFERRED EMBODIMENT

Figures 1, 2, 3, 4, 5, 6:
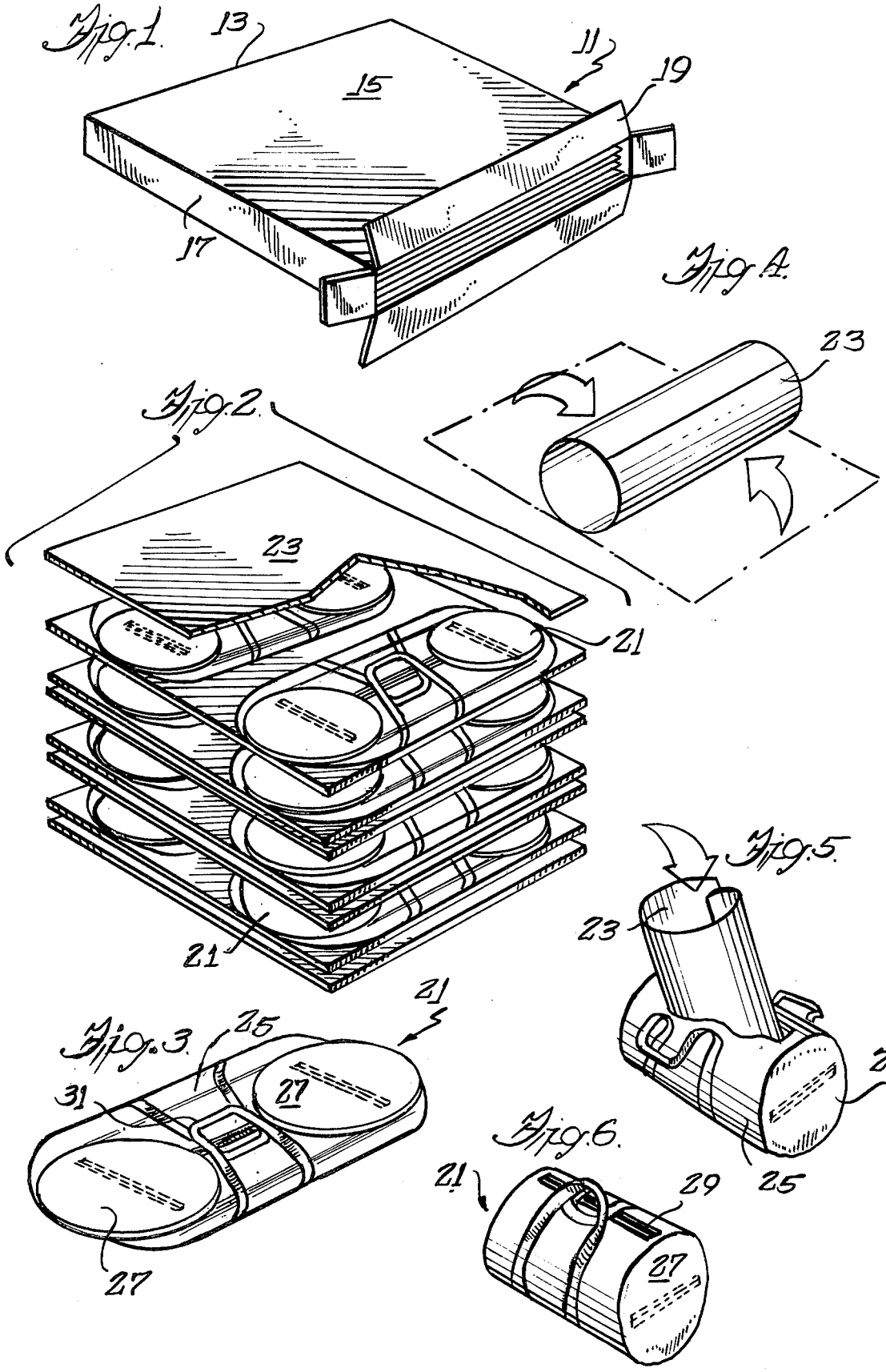
FIG. 1 is a perspective view of the specialty package with the closure open at one end.
FIG. 2 is an exploded perspective view of the contents of the package shown in FIG. 1.
FIG. 3 is an enlarged perspective view of one of the sport bags after its removal from the package of FIG. 1.
FIG. 4 is a diagrammatic view showing the rolling up into a tube of one of the sheets from the package.
FIG. 5 is a perspective view showing the insertion of the rolled up tube into the bag of FIG. 3.
FIG. 6 is a perspective view of the bag of FIG. 5 after insertion of the tube and closing of the zipper.

Illustrated in FIG. 1 is a specialty package 11 generally in the form of a relatively thin flat box designed to accommodate the contents depicted in FIG. 2. As such, the package 11 includes an outer box or container 13 which in its set-up condition has the shape of a parallelepiped, having top and bottom panels 15, a pair of side panels 17 and end closure means 19 for closing both ends, which may be in the form of four flaps as illustrated or any other suitable construction. The box 13 may be made of corrugated fiberboard or some other suitable material and is fabricated in the usual manner with a manufacturer's joint, which might be a glued or stitched flap or a simple taped joint or the like. The length and width of the top panel 15 of the box is proportioned to be slightly greater than the dimensions of a pair of flattened bags, as can be seen in FIG. 2.

The outer box 13 is appropriately sized to accommodate the desired number of layers of flattened bags 21, side-by-side, with at least two bags in each layer arranged on a piece of sheet material 23 which has a shape substantially the same as the shape of the top and bottom panels 15. The contents of the package 11 comprises an equal number of flattened bags 21 and pieces of sheet material 23, and in the illustrated embodiment, 8 bags and 8 sheets are provided. Of course, if three bags are positioned side-by-side in each layer, then twelve sheets 23 would be provided.

The sheets 23 can be of any suitable type of flexible material, such as thin plastic, fiberboard or the like. Preferably, the sheets 23 are rectangular fiberboard sheets of lightweight chipboard or cardboard which can be resiliently rolled into a tube and which will have sufficient memory to attempt to return to its original flat condition.

The illustrated sport bags 21 are of a sewn construction being formed of a major, generally rectangularly main panel 25, two substantially circular end panels 27 and quick-opening means 29, such as a zipper or other zip-opening means or the like. The panels 25 and 27 are cut from a suitable flexible material, such as woven nylon cloth or the like, which has an attractive appearance while resisting ordinary wear and inadvertent damage and abrasion. The zipper 29 runs axially of the body of the cylindrical bag 21 and preferably extends substantially from end panel to end panel. If desired, a slightly shorter zipper might be employed, or a slightly longer one might be arranged at a slight angle to the axis rather than parallel to it, i.e., diagonally, if desired. If required, the dimensions of the sheets 23 could be appropriately adjusted to facilitate use with a slightly shorter zipper.

The bags 21 are preferably provided with suitable carrying means which in the preferred embodiment is a pair of handles 31 which are provided by means of a flexible tape material 33 that is sewn or otherwise suitably attached to the main panel 25 of the bag. For example, the handles may be provided by a strong flexible fabric tape, such as a woven nylon tape about an inch and a half in width. The tape is sewn directly to the main panel, preferably by a pair of lines of stitching, one along each edge, so that two parallel segments substantially encircle the cylindrical body leaving a pair of free loops at each end that serve as the handles 31.

The width of each of the rectangular sheets 23 is preferably just less than the axial dimension of the body of the bag 21 from end panel to end panel. The length of the sheet should be equal to at least about 90% of the circumference of the end panels so that it provides the desired smooth, cylindrical contour for the expanded bag after it has been inserted through the opening provided by the zipper 21 and the zipper has been closed. Of course, it can be of a greater length than the circumference if desired so that it overlaps, and indeed this would be the case if three bags were arranged side-by-side in each layer.

The overall method of merchandising using the invention will be evident from the following illustrative description of the formation of a specialty package 11 and of its ultimate use at the point of sale. A stack is prepared from eight sheets of light cardboard 23 and eight flattened nylon bags 21. The bags 21 are preferably flattened as shown in FIG. 3, with the end panels 27 folded generally atop the remainder of the flattened bag and with the handles 31 folded across each other. Two such folded bags 21 are arranged side-by-side on one or more sheets 23 constituting the bottom of the stack, and then one or two additional sheets are disposed between this layer and the next layer. The steps are then repeated until four layers are provided with at least one sheet 23 covering the uppermost layer.

This stack is then easily inserted through the end opening of a box 13, and the end closure flaps 19 are preferably glued or otherwise secured in closed position. The sheets 23 form compartments in combination with the side and end walls of the box, and the arrangement is such that the bags 21 remain in substantially unwrinkled, folded condition throughout shipping. To assure this is the case, the height or thickness of the box is preferably such that the folded bags 21 are compressed between the respective upper and lower sheets 23 which form the compartments and are held in place by friction even when the orientation of the box is varied.

At the point of ultimate sale, the end closure 19 is opened, and the stack is withdrawn from the box 15. After the zipper 29 on one of the bags 21 has been opened, one of the sheets 23 is rolled or curled into a tube, as illustrated in FIG. 4, and the tube is then inserted into the bag through the opening provided by the zipper, as illustrated in FIG. 5. Once the tube is in the bag and the zipper 29 is closed, the resilient cardboard sheet 23 attempts to return to its flat condition and, as a result, takes a cylindrical shape as restrained by the confines of the bag itself. Thus, the bag 21 assumes an attractive expanded shape and is ready for display at the point of sale to prospective customers.

The invention thus provides a simple but very effective and efficient method of merchandising sport bags of this type requiring a minimum of shipping volume for a plurality of bags which can be quickly set up by a salesperson or a stock-person for display to customers in the attractive expanded condition. Although the invention has been described with regard to certain preferred embodiments, it should be understood that changes and modifications as would be obvious to one having the ordinary skill in this art may be made without deviating from the scope of the invention which is defined in the claims appended hereto.

Particular features of the invention are emphasized in the claims which follow.

What is claimed is:

1. A specialty package for shipping bags made of flexible material, which package comprises an outer box having top, bottom and two side panels and havng end closure means for closing both ends thereof, a plurality of flexible material bags having flexible handles for carrying same, said bags being each designed to have a generally cylindrical shape with a circular cross section and being each provided with quick opening means for gaining entry to the interior thereof, said bags each being folded into a flattened condition and a plurality of pieces of sheet material each having a shape that is substantially the same as the shape of said box top panel, said folded flexible material bags being arranged in layers in stacked relationship between said top and bottom panels with at least one of said sheet material pieces being interposed between adjacent layers of folded bags, whereby upon removal of said bags and sheet material pieces from said outer box, each of said sheet material pieces is rolled into the shape of a tube and inserted through said quick-opening means into one of said bags so that the natural resiliency of said sheet material maintains said bag in unfolded expanded condition suitable for display for sale.

2. A specialty package in accordance with claim 1 wherein said quick-opening means comprises linear zip means which runs parallel to the axis of said cylinder.

3. A specialty package in accordance with claim 2 wherein said bags are made of nylon fabric material.

4. A specialty package in accordance with claim 1 wherein said sheet material pieces are generally rectangular sheets of resilient fiberboard material.

5. A specialty package in accordance with claim 3 wherein two flat-folded bags are disposed side-by-side in each layer, with the shorter dimension of said rectangular sheets being about equal to the axial length of said cylinder and with the longer dimension thereof being equal to at least about 90% of the circumference of said circular cross section.

* * * * *